US006070595A

United States Patent [19]

Baltierra

[11] Patent Number: 6,070,595

[45] Date of Patent: Jun. 6, 2000

[54] METHOD FOR APPLYING A COMBINATION OF ACRYLIC LIQUID AND POWDER TO NAIL SURFACE

[76] Inventor: Julie Baltierra, 2243 Pacific Ave., No. 104-A, Costa Mesa, Calif. 92627

[21] Appl. No.: 08/833,541

[22] Filed: Apr. 7, 1997

[51] Int. Cl.[7] ..... A45D 24/00; A45D 29/00

[52] U.S. Cl. ..... 132/200; 132/74.5; 132/313

[58] Field of Search ..... 132/313, 200, 132/74.5, 73, 317, 73.5, 285, 112, 116; 401/183, 271, 282, 286, 290

[56] References Cited

U.S. PATENT DOCUMENTS

| | | | |
|---|---|---|---|
| 140,228 | 6/1873 | Wentworth | 401/183 |
| 450,662 | 4/1891 | Darrell | 401/183 |
| 506,156 | 10/1893 | Chase | 401/183 |
| 824,688 | 6/1906 | Ferris | 401/290 |
| 1,080,574 | 12/1913 | Moss | 132/74.5 |
| 1,428,807 | 9/1922 | Rose | 401/282 |
| 1,693,330 | 11/1928 | Astley | 401/271 |
| 1,694,306 | 12/1928 | Astley | 401/290 |
| 1,945,957 | 2/1934 | Slamon | 401/286 |
| 1,960,387 | 5/1934 | Marcher | 401/99 |
| 3,386,792 | 6/1968 | Ireland | 401/183 |
| 3,592,202 | 7/1971 | Jones | 132/313 |
| 4,587,983 | 5/1986 | Wissman et al. | 132/73 |
| 4,625,741 | 12/1986 | Gardiner | 401/183 |
| 4,726,386 | 2/1988 | Schultz | 132/317 |
| 5,271,513 | 12/1993 | Crosnier et al. | 401/271 |
| 5,403,107 | 4/1995 | Griffith et al. | 401/271 |
| 5,588,447 | 12/1996 | Gueret | 132/200 |

FOREIGN PATENT DOCUMENTS

| | | | |
|---|---|---|---|
| 4335527 | 2/1994 | Germany | 132/73 |
| 583203 | 10/1958 | Italy | 132/73 |

*Primary Examiner*—Gene Mancene
*Assistant Examiner*—Eduardo C. Robert
*Attorney, Agent, or Firm*—Leonard Tachner

[57] ABSTRACT

A dispenser brush applicator which may be used advantageously for applying a liquid and powder combination acrylic to nail surfaces. The applicator comprises a plastic squeeze bottle having an open end enclosed by a brush member. The brush member has a cap terminating in a conically-shaped bristle holder that is generally hollow and is plugged at its base end with a channeled plug. A passage in the plug meters a controllable amount of liquid out of the squeeze bottle. The other end of the holder has a staple through which a plurality of bristles are looped, their free ends extending through the holder at a reduction aperture, the free ends generally terminating at a common plane a selected distance from the bottle. When the bottle is partially or completely filled with a liquid, the bottle may be squeezed thereby forcing the liquid through the plug and into contact with the bristles. The liquid is forced out of the plug along the bristles, soaking the bristles whereby the liquid may collect the powder necessary to complete the acrylic product application to the nail surface when that surface is contacted by the wetted bristles.

1 Claim, 3 Drawing Sheets

METHOD FOR APPLYING A COMBINATION OF ACRYLIC LIQUID AND POWDER TO NAIL SURFACE

BACKGROUND OF THE INVENTION

1. Field of the Invention

The present invention relates generally to the field of manicuring appliances and more specifically to a dispenser brush applicator which is especially advantageous for supplying viscous fluids in controlled quantities sufficient to collect the required amount of powder in application of acrylic fingernails to natural nail surfaces.

2. Prior Art

Acrylics applied to nail surfaces provide aesthetic and structural enhancement by filling microscopic grooves and gaps and by covering the entire exposed nail surface with a liquid and powder combination which hardens after application to the natural nail. The applied acrylic can comprise a selected mixture of liquid and powder forms of acrylic. Of course, there are prior art devices for applying acrylics to nail surfaces. One such conventional applicator consists of a simple brush which is dipped into a container of liquid acrylic to wet the bristles and then dipped into powder acrylic before being applied to the nails. In some cases, the brush bristles are attached to the cap of the bottle of acrylic, so that the bottle cap becomes a holder of the bristles when the cap is removed from the bottle. However, such prior art devices make it necessary to perform the additional step of first dipping the brush into the liquid acrylic before dipping the wet brush into the acrylic powder and then applying the liquid and powder acrylic mixture to the nail surfaces.

It would be advantageous to provide a means to obviate that extra step. By avoiding the step of dipping the brush into the liquid, a significant amount of time may be saved. By shortening the time for applying acrylic to each nail, the total time saved for many pairs of hands becomes very significant.

SUMMARY OF THE INVENTION

The present invention comprises a dispenser brush applicator which may be used advantageously for applying liquid acrylic to nail surfaces. The applicator comprises a plastic squeeze bottle having an open end enclosed by a brush member. The brush member has a cap terminating in a conically-shaped bristle holder that is generally hollow and is plugged at its base end with a channeled plug. A passage in the plug meters a controllable amount of liquid out of the squeeze bottle. The other end of the holder has a staple through which a plurality of bristles are looped, their free ends extending through the holder at a reduction aperture, the free ends generally terminating at a common plane a selected distance from the bottle. When the bottle is partially or completely filled with a liquid, the bottle may be squeezed thereby forcing the liquid through the plug and into contact with the bristles. The liquid is forced out of the plug along the bristles, soaking the bristles whereby the liquid may be adhered to the nail surface when that surface is contacted by the wetted bristles. Normally, the wet bristles are first dipped into powder acrylic before the mixture of liquid and powder acrylic is applied to nail surfaces.

OBJECTS OF THE INVENTION

It is therefore a principal object of the present invention to provide a manicuring dispenser brush applicator for dispensing viscous liquids directly from brush bristles without first requiring dipping the brush into such liquids.

It is another object of the invention to provide a dispenser that contains liquids and applies liquids through a brush.

It is still another object of the invention to provide a squeeze bottle terminating in brush bristles for dispensing a liquid onto the brush upon application of a compressive force to the squeeze bottle.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
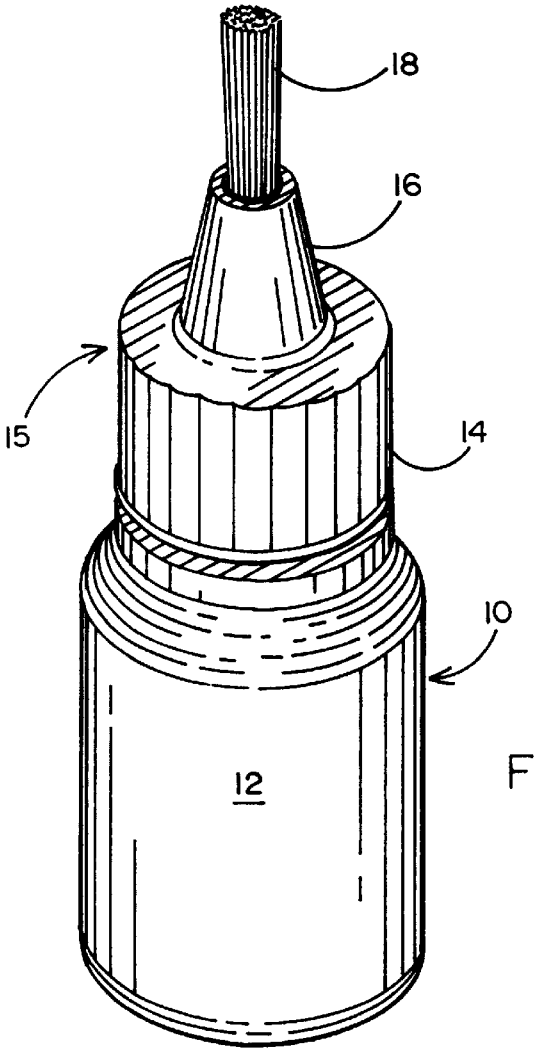
FIG. 1 is a three-dimensional view of the invention shown fully assembled.
Figure 2:
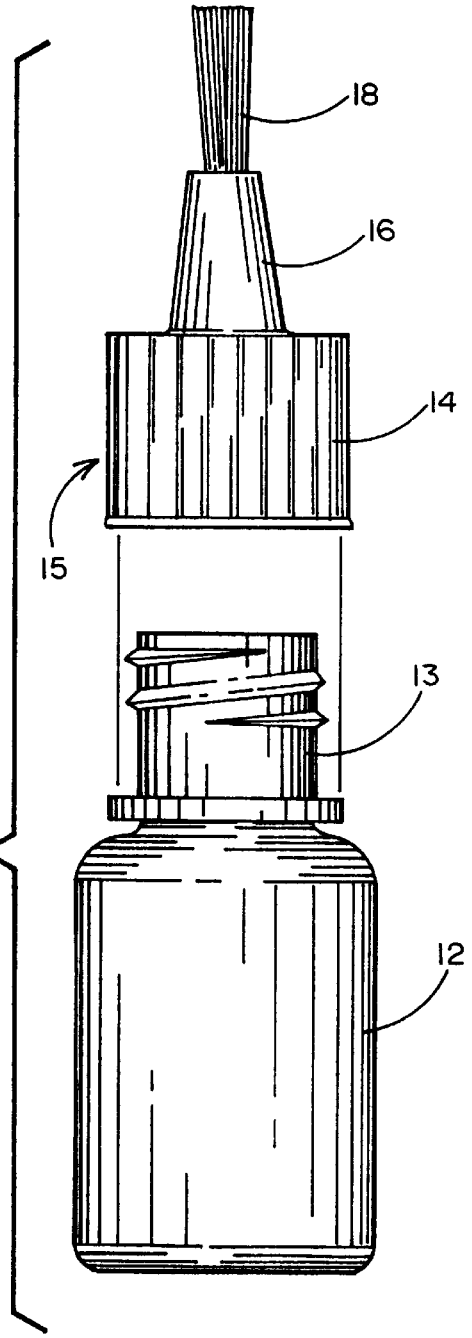
FIG. 2 is an elevational view of the invention shown with the brush member separated from the bottle.

Referring to the accompanying figures, it will be seen that a manicuring dispenser brush applicator 10 in accordance with the present invention comprises a squeeze bottle 12 having a threaded open end 13. Applicator 10 also comprises a brush member 15 having a cap 14 and an integral brush holder 16 from which brush bristles 18 extend.

Figure 5:
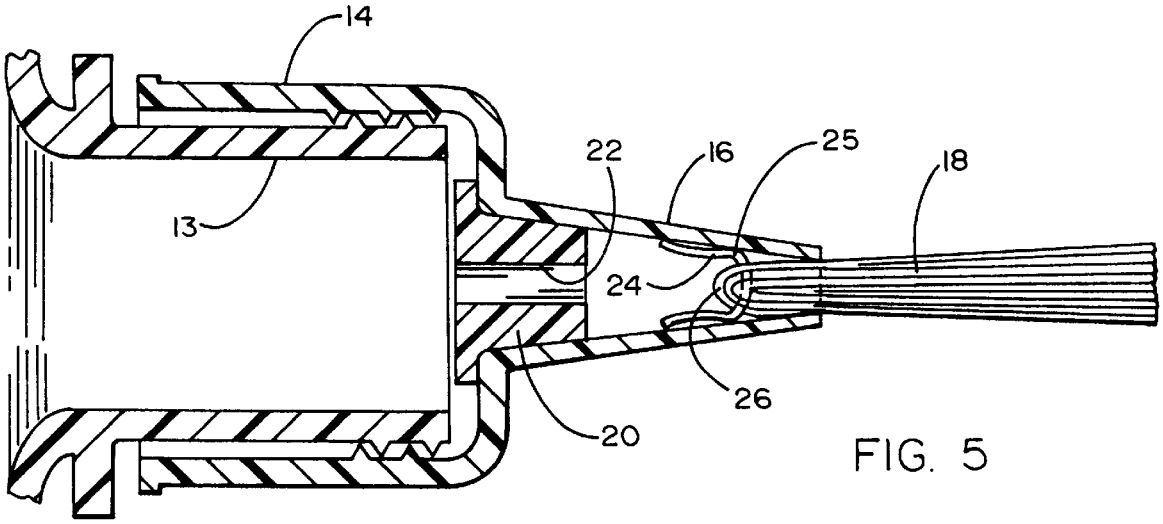
FIG. 5 is a cutaway cross-sectional view of the brush member mounted on the threaded end of the bottle.

As shown in FIG. 5, cap 14 is threaded onto bottle end 13 to enclose the bottle 12. A plug 20 is positioned within the conically shaped holder 16 and provides a passage 22 which feeds liquid out of bottle 12 and into holder 16. A staple 24 is secured within holder 16 and provides an arcuate mid-portion 25. Bristles 18 are formed into a single-turn (180 degree) loop 26 which extends around mid-portion 25 of staple 24. The staple thus holds the loop end of the bristles 18 within the holder and exposed to liquid which flows through passage 22 of plug 20.

Figure 3:
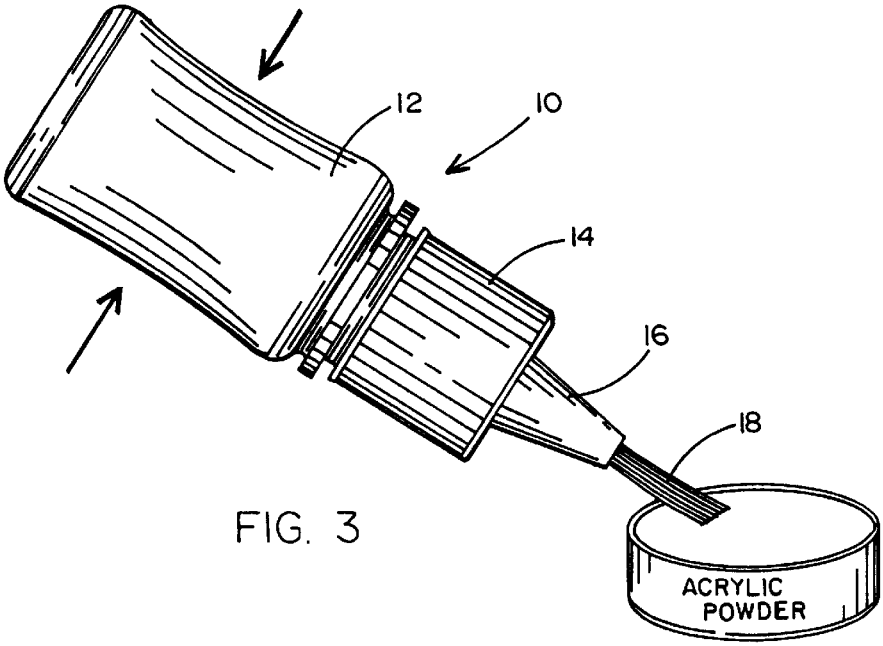
FIG. 3 is a view of the invention showing wetted bristles being dipped into acrylic powder.
Figure 4:
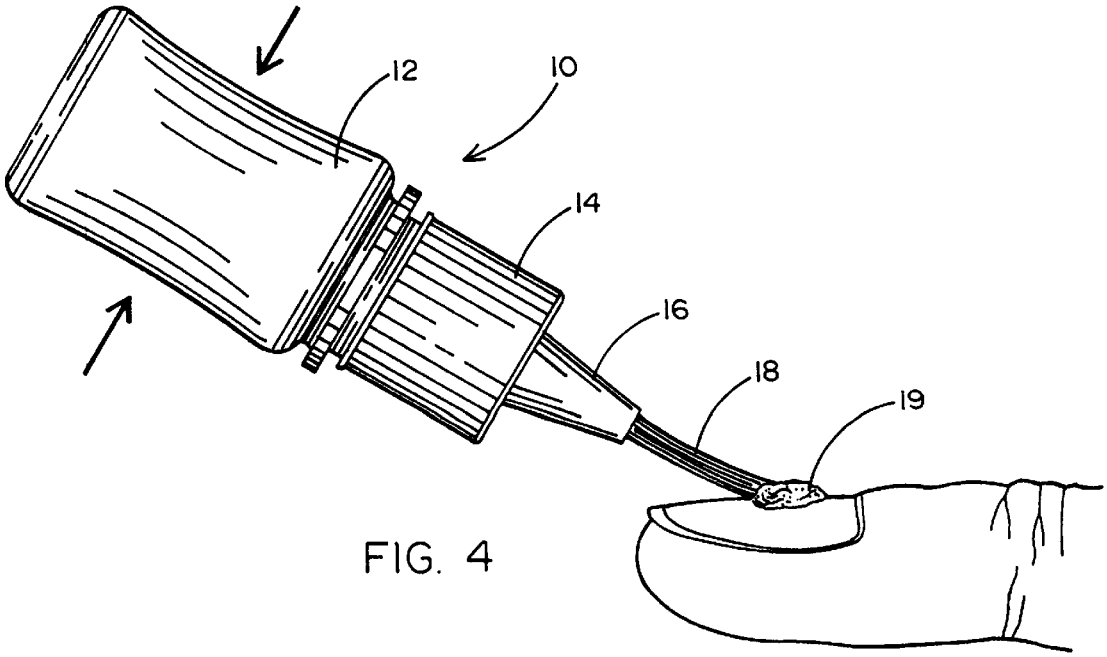
FIG. 4 is a view of the invention showing its configuration during manicuring use.

As seen in FIGS. 3 and 4, the applicator 10 is used to dispense liquids to the powder surface by squeezing bottle 12 in a partially inverted position. Liquid within the bottle is forced through passage 22 of plug 20 and onto the bristles, flowing along the bristles. The wet bristles are applied to a powder-like substance, such as powdered acrylic, before the combination 19 of acrylic liquid and powder is applied to the nail surface.

Thus, it will now be seen that the present invention provides a manicuring dispenser brush applicator for dispensing viscous liquids directly from brush bristles without first requiring dipping the brush into the liquids. Those having skill in the relevant art will now perceive various modifications and additions which may be made to the invention. By way of example, the precise shape and dimensions depicted herein by way of exemplary embodiment, may be readily altered. Accordingly, all such modifications and additions are deemed to be within the scope of the invention, which is limited only by the appended claims and their equivalents.

I claim:

1. A method for applying a combination of acrylic liquid and powder to nail surfaces, the method comprising the following steps:

a) providing a compressible bottle having an opening at an end thereof and a brush member threadibly connected to said bottle at said end, said brush member having a passage leading from said bottle opening and compressibly retaining a plurality of brush bristles as a unitary bundle;

b) at least partially filing said bottle with said acrylic liquid;

c) wetting said bristles with acrylic liquid by compressing said bottle;

d) dipping said wetted bristles into said acrylic powder until a selected quantity of said powder adheres to said wetted bristles; and e) applying said liquid and powder to the surface of a human nail.

* * * * *